US009789583B2

(12) United States Patent
Persson

(10) Patent No.: US 9,789,583 B2
(45) Date of Patent: Oct. 17, 2017

(54) ADJUSTABLE GRINDING JIG

(71) Applicant: Tormek AB, Lindesberg (SE)

(72) Inventor: Håkan Persson, Lindesberg (SE)

(73) Assignee: TORMEK AB, Lindesberg (SE)

( * ) Notice: Subject to any disclaimer, the term of this patent is extended or adjusted under 35 U.S.C. 154(b) by 92 days.

(21) Appl. No.: 15/010,989

(22) Filed: Jan. 29, 2016

(65) Prior Publication Data

US 2016/0236319 A1 Aug. 18, 2016

(30) Foreign Application Priority Data

Feb. 18, 2015 (SE) ..... 1550174

(51) Int. Cl.
*B24B 41/06* (2012.01)
*B24B 3/36* (2006.01)
*B24B 3/40* (2006.01)

(52) U.S. Cl.
CPC ..... *B24B 41/066* (2013.01); *B24B 3/36* (2013.01); *B24B 3/40* (2013.01); *B24B 41/06* (2013.01)

(58) Field of Classification Search
CPC ..... B24B 41/066; B24B 3/36; B24B 3/40; B24B 41/06
USPC ..... 451/367
See application file for complete search history.

(56) References Cited

U.S. PATENT DOCUMENTS 3,881,888 A * 5/1975 Schwab ..... B24B 3/36 269/71
5,582,542 A * 12/1996 Stein ..... B24B 15/06 451/367
5,938,511 A * 8/1999 Patterson ..... B24B 3/36 451/365
6,475,074 B2 * 11/2002 Blanton ..... B24B 3/34 144/134.1

(Continued)

FOREIGN PATENT DOCUMENTS

EP 1987916 B1 1/2011
WO WO 2007/098470 A2 8/2007

OTHER PUBLICATIONS

Office Action for Swedish Application No. 1550174-5, dated Aug. 27, 2015 (4 pages).

(Continued)

*Primary Examiner* — George Nguyen
(74) *Attorney, Agent, or Firm* — Merchant & Gould P.C.

(57) ABSTRACT

A grinding jig for holding an edged tool in a grinding machine. The grinding jig comprises a base having a plane support surface for supporting a section of the face of an edged tool. The grinding jig further comprises a clamping means. The clamping means is arranged to clamp a section of the face of an edged tool against the flat support surface. A first and a second support leg extend from opposite ends of the base. Each support leg comprises an opening adapted to slidably and rotationally receive a grinding jig support bar of a grinding machine. In embodiments described herein one support leg is pivotally attached to the base around an axis (Continued)

parallel with the extension of the plane support surface. The grinding jig further comprises a first adjustable stop means for adjustably limiting the pivotal movement of the support leg in a first direction. The grinding jig further comprises a second adjustable stop means for adjustably limiting the pivotal movement of the support leg in a second direction.

10 Claims, 4 Drawing Sheets

(56) References Cited

U.S. PATENT DOCUMENTS

| | | | | |
|---|---|---|---|---|
| 6,676,495 | B1 * | 1/2004 | Siemers | B24B 3/36 451/278 |
| 7,033,247 | B2 * | 4/2006 | Zhang | B24B 41/06 451/11 |
| 7,281,969 | B2 * | 10/2007 | Naples | B24B 41/066 451/193 |
| 7,686,678 | B2 * | 3/2010 | Jansson | B24B 41/066 451/367 |
| 2006/0211348 | A1 * | 9/2006 | Hyde | B24B 3/38 451/367 |

OTHER PUBLICATIONS

Extended European Search Report for EP Application No. 16152677.7, dated Sep. 28, 2016.

* cited by examiner

ADJUSTABLE GRINDING JIG

This application claims benefit of Ser. No. 1550174-5, filed 18 Feb. 2015 in Sweden, which application is incorporated herein by reference. To the extent appropriate, a claim of priority is made to each of the above disclosed application.

TECHNICAL FIELD

The present disclosure relates to a grinding jig for holding an edged tool in a grinding machine. The present disclosure also relates to a grinding machine comprising the grinding jig.

BACKGROUND ART

Edged tools, in particular for wood working such as plane irons, wood chisels or spoke shave blades generally need to have a sharp edge with a well defined shape. In certain applications, the tool, e.g. a plane iron, may have a so called straight edge in which the front of the edge generally forms a 90° angle with the sides of the tool. In other applications, the edge of the plane iron may have a generally cambered shape.

Sharpening of the tools is typically performed in a grinding machine which comprises a rotating grindstone and a grinding jig to assist the operator to maintain the angle of the edge of the tool during grinding.

When grinding straight edged tools it is important to maintain the faces of the tool in parallel orientation with the grinding surface of the grindstone. This is so because the front of the edge of the tool will be ground skew if the face of the tool is oriented in an angle with respect to the surface of the grindstone.

This problem has been addressed in EP 1987916 B1 which shows a grinding jig comprising a base provided with a vertical shoulder and a plane support surface for supporting the face of the edged tool. A clamp is movable against the support surface by means of two screws which extends into the clamp through holes in the base on either sides of the support surface. When the tool is clamped in the jig by tightening of the screws, the support surface and the shoulder guides the face of the tool into parallel orientation with the grinding surface of the grindstone.

However, although the grinding jig disclosed in EP1987916 B1 has proven to be very effective, an inexperienced operator may face difficulties in tightening the screws of the clamp in a proper manner, e.g. one screw may be tightened harder than the other. This may result in an uneven clamping pressure across the tool which forces the face of the tool into misalignment with the grinding surface and results in a skewness of the tools edge after grinding.

Thus, it is an object of the present disclosure to provide a grinding jig which addresses at least one of the aforementioned problems.

In particular, it is an object of the present disclosure to provide a grinding jig which allows for simplified alignment between the front edge of the tool and grinding surface of the grindstone. A further object of the present disclosure is to provide a grinding jig which allows for high accuracy of the alignment between the tool and the grinding surface of the grindstone. A further object of the present disclosure is to provide a simple but yet robust grinding jig which may be produced at low cost.

SUMMARY OF THE DISCLOSURE

According to a first aspect of the present disclosure, at least one of these objects is achieved by a grinding jig 100 for holding an edged tool 200 in a grinding machine 400. The grinding jig 100 comprises a base 110 having a plane support surface 113 for supporting a section of the face 240 of an edged tool 200. The grinding jig further comprises a clamping means 120. The clamping means 120 is arranged to clamp a section of the face 240 of an edged tool 200 against the flat support surface 113. A first and a second support leg 130, 140 extend from opposite ends of the base 110. Each support leg 130, 140 comprises an opening 131, 141 adapted to slidably and rotationally receive a grinding jig support bar 300 of a grinding machine 400. In embodiments described herein one support leg 140 is pivotally attached to the base 110 around an axis (C) parallel with the extension of the plane support surface 113. The grinding jig 100 further comprises a first adjustable stop means 150 for adjustably limiting the pivotal movement of the support leg 140 in a first direction (A). The grinding jig 100 further comprises and a second adjustable stop means 151 for adjustably limiting the pivotal movement of the support leg 140 in a second direction (B).

The grinding jig according to the present disclosure considerably facilitates the alignment of a tool to be grinded in relation to the grinding surface of the grinding stone. One advantage thereof is that an inexperienced operator may achieve sharp and well defined edges of high quality. Another advantage is that the grinding jig described in the present disclosure may achieve a considerable increase in productivity since the operator may be able to perform the alignment between the tool and the grinding surface in short time.

In practice, a straight edged tool to be grinded is placed in the grinding jig and clamped between the clamping means and the plane support surface of the base. Subsequently the jig is rotated to place the edge of the tool into contact with the grinding surface of the grinding stone. In this position, the operator may visually detect any misalignment between the face of the tool and the grinding surface, typically as a small wedge shaped gap between the edge of the tool and the grinding surface. A necessary correction of the alignment of the tool is then easily performed by adjusting the stop means to change the angular position of the pivotal support leg in relation to the base. This will in turn cause the base of the jig, and thus the face of the tool, to tilt in transverse direction with respect to the grinding surface of the grindstone until the face of the tool is in parallel alignment with the grinding surface.

The function of the grinding jig according to the present disclosure is schematically illustrated in FIG. 1*a* and 1*b*. FIG. 1*a* shows, in a front view, the front edge 210 of a tool 200 which is misaligned by an angle $\alpha$ with respect to the grinding surface 420 of a cylindrical grindstone 410. The double arrow P indicates the transverse direction across the grindstone. FIG. 1*b* shows the edge 210 of a tool 200 which is in parallel alignment with the grinding surface 420 of the grinding stone 410.

An additional advantage with the grinding jig according to the present disclosure is that it may be used for grinding tools with cambered edges, such as plane irons. When such tools are ground, the tool is held against the grinding surface and is continuously tilted back and forth in traverse direction with respect to the grinding surface to achieve uniform grinding of the edge. The tool is tilted from one longitudinal side to the other as the grinding jig is moved across the grinding surface of the grinding stone.

To enable grinding of tools with cambered edges in the grinding jig according to the present disclosure both stop means may be adjusted such that the pivotally attached support leg may freely pivot between the two stop means. The position of the stop means may be adjusted in dependency of the degree of camber of the tool's edge.

According to an alternative, the pivotal support leg 140 may be pivotally attached to a shaft 117 extending from an end surface of the base 110.

The pivotal support leg may comprise an opening 144 for receiving the shaft 117. The opening 144 for receiving the shaft 117 and the opening 131, 141 for receiving the support bar 300 are preferably positioned in line with each other in the centre of the support leg. An adjustment of the angular position of the pivotal support leg therefore results in a direct and proportional change in the alignment between the base of the grinding jig (and thus the face of the tool) and the grinding surface of the grindstone.

The pivotal support leg 140 may comprise an abutment surface 145. The adjustable stop means 150, 151 may thereby be arranged to engage the abutment surface 145.

According to an alternative, the abutment surface 145 extends on opposite sides of the shaft 117. The angular position of the pivotal support leg may thereby easily be adjusted with high accuracy.

Preferably, the plane support surface 113 comprises at least one shoulder 114 for supporting one of the longitudinal sides of the tool. The shoulder 114 is perpendicular to the longitudinal extension of the base. When a longitudinal side of the tool is supported against the shoulder the edge tool is oriented transverse to the grinding surface of the grindstone.

The base 110 may comprise a holding section 154 for holding the adjustable stop means 150, 151. The holding section may protrude over the abutment surface 145 of the pivotal support leg 130, 140. Thereby, an overall compact and robust grinding jig is achieved.

The holding section 154 may comprise a first and a second opening 155, 156 for receiving the first and the second adjustable stop means 150, 151. The first and the second openings 155, 156 and the first and the second adjustable stop means 150, 151 may comprise mating inner and outer threads such that the adjustable stop means 150, 151 may be advanced towards the abutment surface or retracted there from by screwing of the adjustable stop means 150, 151. Threaded stop means, for example in the form of screws, are advantageous since they, when engaging the treaded holes, allow for very precise adjustment of the pivotal movement of the pivotal support leg. Moreover, due to the engagement between the outer thread on the screws and the inner thread in the openings, the stop means maintain their position during use of the grinding jig.

According to a second aspect, the present disclosure relates to a grinding machine 400 comprising a grindstone 410, a motor for rotating the grindstone and a support bar 300 for supporting a grinding jig 100, characterized in that the grinding machine 400 comprises the grinding jig according to the first aspect.

DEFINITIONS

Figure 2A:
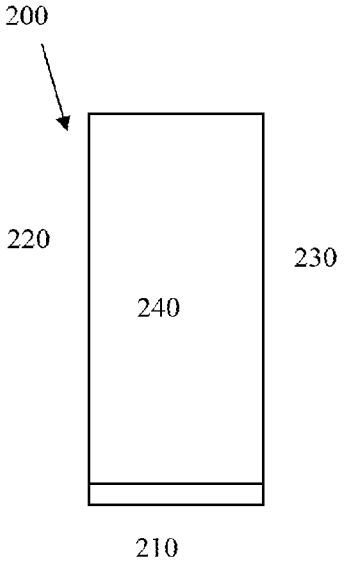
FIG. 2*a*, 2*b*: Schematic drawings showing edged tools of different types.
Figure 2B:
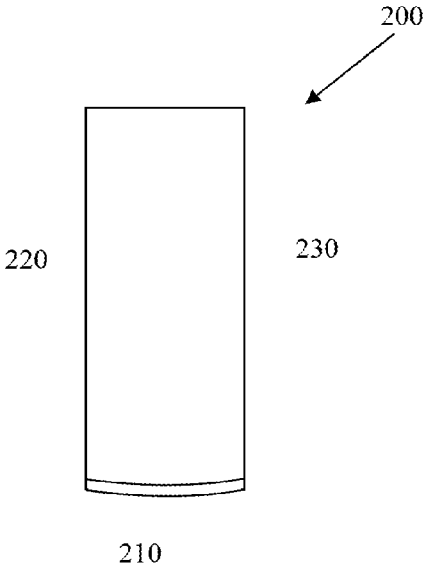

In the present disclosure reference is made to edged tools and various portions thereof. For clarity, the various portions of the tool will be defined with reference to FIG. 2*a* which schematically shows a tool 200 having straight edge 210, a first and a second longitudinal side 220, 230 and a first and second face (of which only face 240 is visible). A tool with a cambered edge 201, i.e. the edge has a radius, is shown in FIG. 2*b*. In other words, the edge 201 in FIG. 2*b* is curved.

By "adjustable stop means" is meant that the stop means may be moved or operated or otherwise displaced to provide various or different angular end positions for the pivotal movement of the pivotal support leg in a first pivotal direction A and a second direction B.

DETAILED DESCRIPTION OF EMBODIMENTS

The grinding jig according to the present disclosure will now be described more fully hereinafter. The grinding jig according to the present disclosure may, however, be embodied in many different forms and should not be construed as limited to the embodiments set forth herein; rather, these embodiments are provided by way of example so that this disclosure will be thorough and complete, and will fully convey the scope of the present disclosure to those persons skilled in the art. Like reference number refer to like elements throughout the description.

Figure 3:
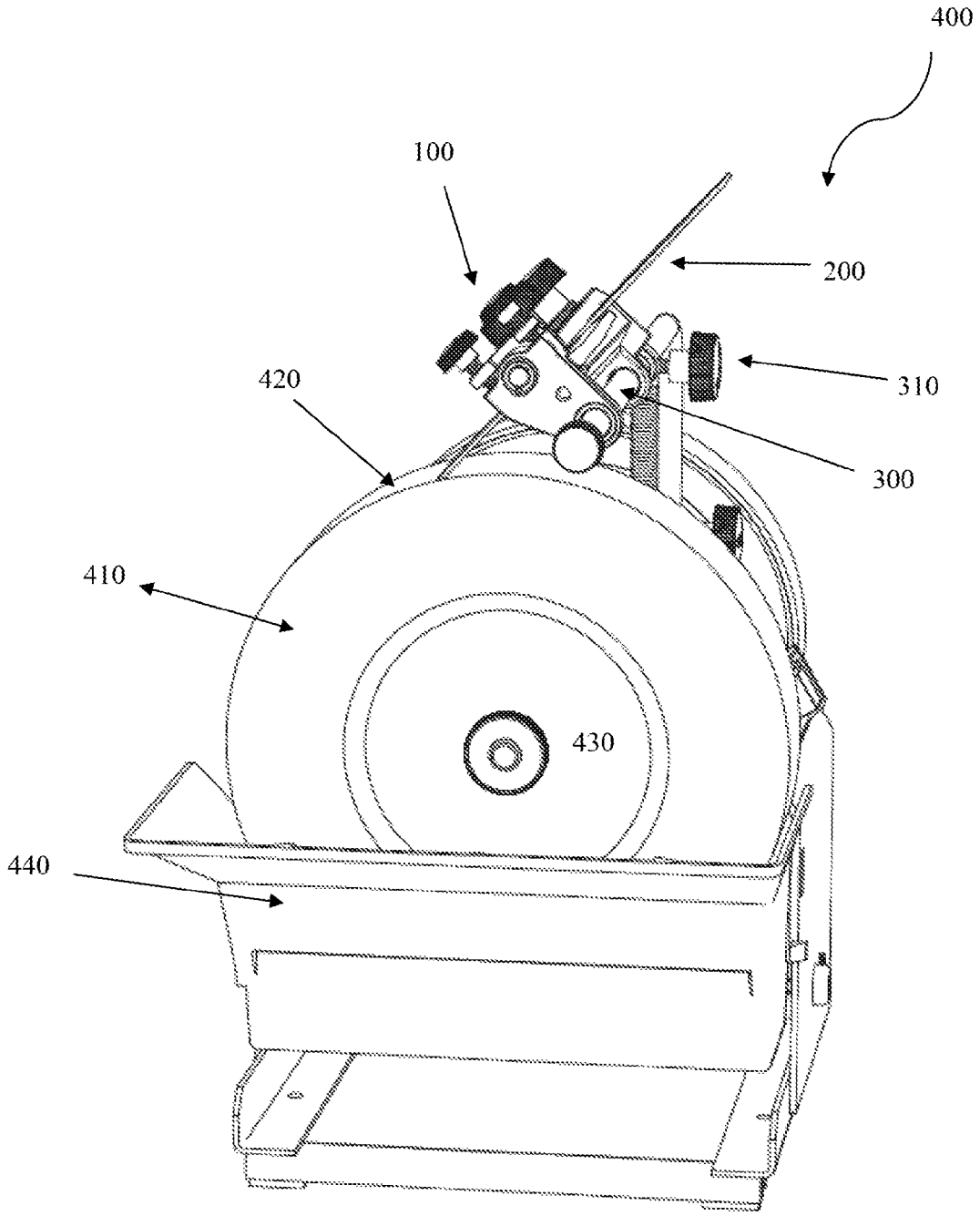
FIG. 3: A schematic drawing showing a grinding machine comprising a grinding jig according to a first preferred embodiment of the present disclosure.

FIG. 3 shows schematically a grinding machine 400 comprising a grinding jig 100 according to a first preferred embodiment of the present disclosure. An edged tool 200 to be ground is clamped in the grinding jig. The grinding machine 400 comprises a cylindrical grindstone 410 having a grinding surface 420. The grindstone 410 is rotated by a motor (not shown) which may be connected to a shaft 430 running through the centre of the grindstone. The motor may for example be an electrical motor. A trough 440 for grinding liquid, such as water or oil, may be arranged under the grindstone. The grinding machine further comprises a support bar 300, also called universal support, for supporting the grinding jig 100. The support bar 300 extends over the grinding surface 420 parallel to the axis of rotation of the grinding stone, i.e. the shaft 430. The support bar 300 may be telescopic so that the distance between the support bar and the grinding surface may be adjusted and locked by a locking knob 310. The extension of the support bar in direction across the grindstone may also adjustable. The grinding machine 400 may be any type of conventional grinding machine for grinding edged tools, such as plane irons, wood chisels and spoke shave blades. For example, the grinding machine may be a Tormek T-7 which is commercially available from the company Tormek AB.

Figure 1A:
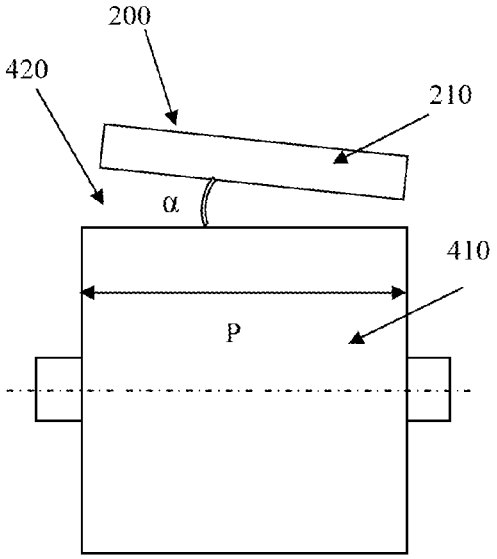
FIG. 1*a*, 1*b*: Schematic drawings showing misalignment and alignment between a tool and grindstone, respectively.
Figure 1B:
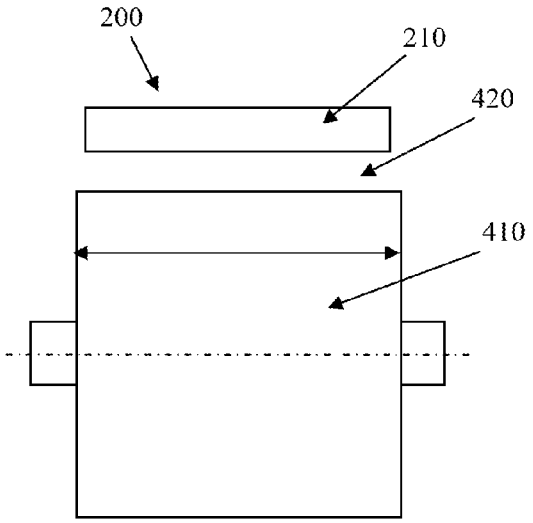
Figure 4:
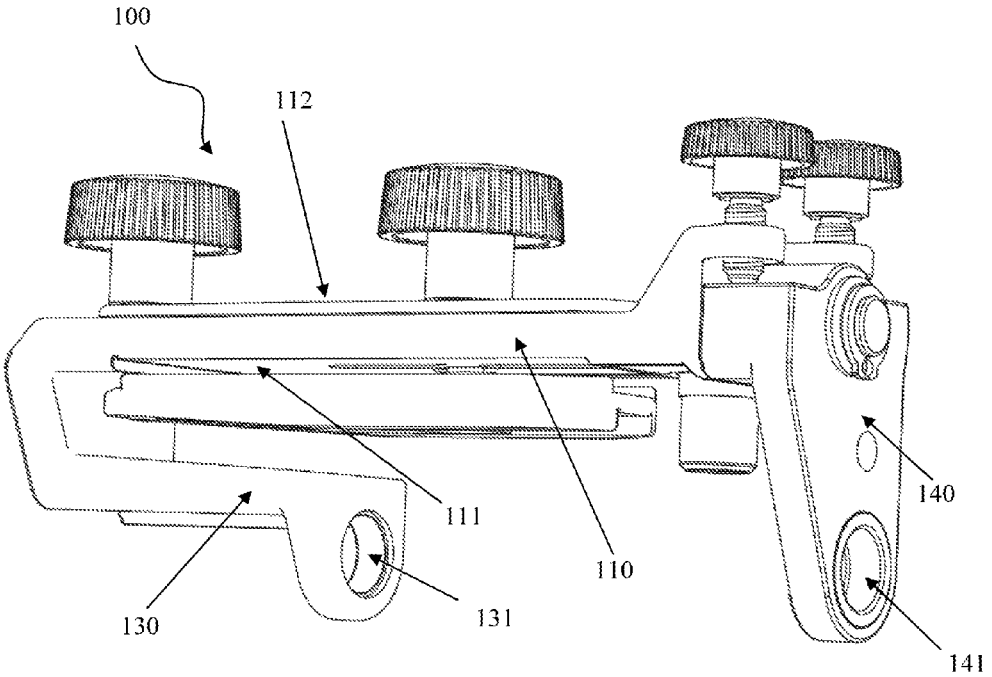
FIG. 4: A schematic drawing showing a grinding jig according to a first preferred embodiment of the present disclosure in a perspective front view.

FIG. 4 shows schematically the grinding jig according to a first preferred embodiment of the present disclosure. The grinding jig 100 comprises a base 110 which may be of elongated shape and may comprise two opposing long sides and two opposing short sides. In FIG. 4 the base is of elongated rectangular shape, however other forms of the base are feasible within the present disclosure. The base 110 has an inner side 111 and an outer side 112 (the outer side is visible in FIG. 6). When the grinding jig is mounted on the support bar, the inner side 111 is directed towards the grindstone. Two support legs 130, 140 extend from the opposite ends of the base 110, i.e. the short sides of the base 110. Each support leg 130, 140 comprises a through hole 131, 141 for slidable and rotationally mounting the grinding jig onto the support bar 300, as shown in FIG. 1.

Figure 5:
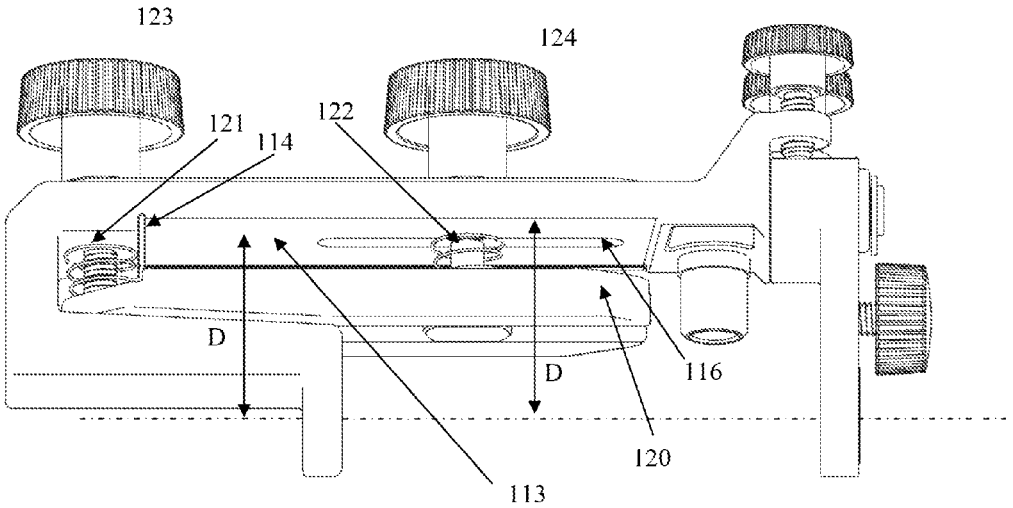
FIG. 5: A schematic drawing showing a grinding jig according to a first preferred embodiment of the present disclosure in a view from below.

With reference to FIG. 5, the inner side 111 of the base 110 comprises a plane support which comprises at least one shoulder 114. In more detail, the support surface 113 may be a rectangular recess in the inner side 111 of the base whereby one of the opposing short sides of the recess forms the at least one shoulder 114. In particular, the at least one the shoulder is located at the side of the fixed support leg. By "plane support surface" is meant that the distance D between the plane support surface 113 and the centre of the through holes 131, 141 in the support legs is equal over the plane support surface. The centre of the through holes of the support legs is indicated by the dashed line in FIG. 5. When the grinding jig is mounted on the support bar 300, the plane support surface 113 will therefore be parallel to the support bar and thus also parallel with the grinding surface of the grindstone. The purpose of the plane support surface 113 is to guide the face of the tool into parallel alignment with the grinding surface of the grindstone. The at least one shoulder 114 is perpendicular to the longitudinal extension of the base, i.e. the long sides of the base and are intended to support one of the longitudinal sides of the tool so that the edge of the tool is oriented transverse to the grinding surface of the grindstone.

A clamping means 120 for clamping a tool to be ground in the grinding jig is arranged opposite to the plane support surface 113, such that the clamping means 120 faces the plane support surface 113. As shown in FIG. 5, the clamping means 120 may extend over the plane support surface and its shape may correspond to the shape of the plane support surface. In order to move the clamping means 120 towards the plane support surface, two clamping screws 121, 122 may be provided. The clamping screws may extend through openings in the outer side 112 of the base 110 into openings in the clamping means 120. Knobs 123, 124 for turning the clamping screws may be provided on the ends of the screws on the outer side 112 of the base 110. By turning the knobs 123, 124, the clamping means 120 may be moved towards the plane support surface 113. According to one alternative (not shown), the clamping screws may extend through threaded holes in opposite ends of the clamping means. According to another alternative, as shown in FIG. 5, one of the clamping screws 121 may extend through a threaded hole in a first end of the clamping means 120. The other clamping screw 122 may be movable in an elongated opening 116 through the base 110 and through the clamping means 120. The elongated opening 116 may extend from a second end of the clamping means towards the first end thereof and makes it possible to adjust the distance between the two clamping screws 121, 122 and thereby optimizing the clamping pressure for various tool widths.

Figure 6:
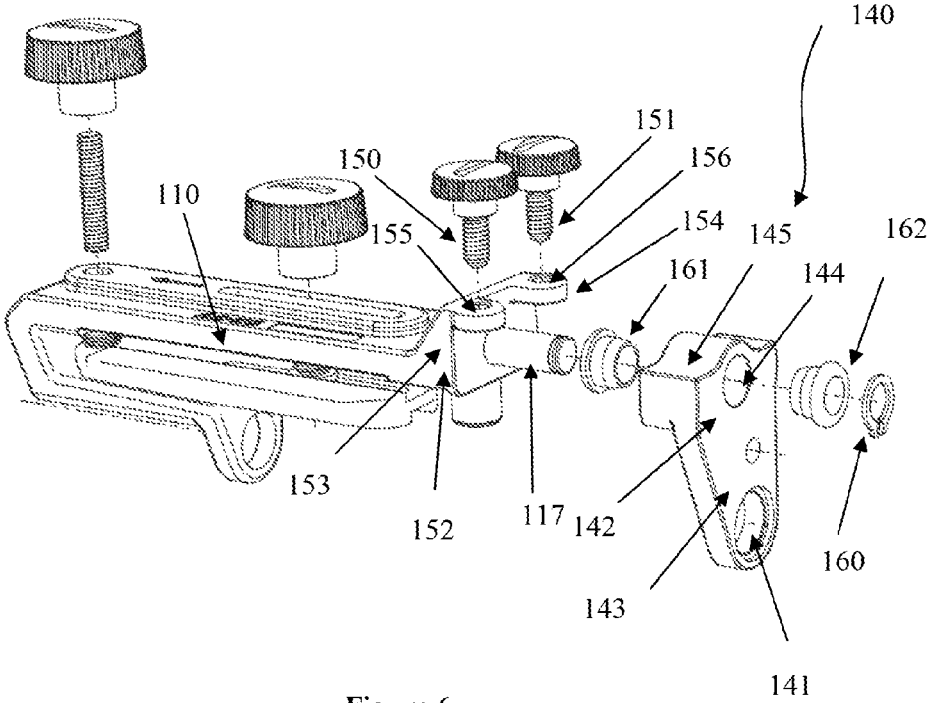
FIG. 6: A schematic drawing showing a grinding jig according to a first embodiment of the present disclosure in an exploded view.

According to the present disclosure, one support leg 140 is pivotally attached to the base 110. The support leg 140 is thereby pivotal around an axis which is parallel to the extension of the parallel surface 113. The other support leg 130 is preferably immovable in relation to the base. For example this support leg may be formed in one piece with the base or it may be fixed to the base by bolts. FIG. 6 shows an exploded view of the inventive grinding jig. In the embodiment shown in FIG. 6, the pivotal support leg 140 comprises a rectangular upper portion 142 and a triangular lower portion 143. However, the pivotal support leg 140 may have any other suitable form such as entirely rectangular or triangular. The lower portion of the pivotal support leg 140 comprises an opening 141 for receiving a support bar of grinding machine. The upper portion 142 may comprise an opening 144 for receiving a shaft 117 for pivotally attaching the support leg to the base 110. The upper opening 144 for the shaft and the lower opening 141 for the support bar are preferably positioned in line with each other in the center of the support leg 140. The upper portion 142 of the pivotal support leg 140 may further comprise an abutment surface 145 for engagement with two stop means, which will be described in detail below. In the shown embodiment, the abutment surface 145 protrudes from the otherwise flat support leg 140. However, the abutment surface 145 may also be constituted by the upper side surface of the pivotal support leg, which in that case may be of uniform thickness. The abutment surface 145 may extend on both sides of the upper opening 144 in the pivotal support leg for receiving the pivot shaft.

The base 110 may comprise a shaft 117 which protrudes from one short side of the base 110 in direction of the longitudinal extension of the base, i.e. parallel to the extension of plane support surface 113. The shaft 117 is preferably dimensioned to fit into the upper opening 144 in the support leg. The shaft may optionally be fitted into the upper opening of the support leg together with two bushings 161, 162.

The base 110 further comprises a first and a second stop means 150, 151 for adjustable limiting the pivotal movement of the pivotal support leg 140. As is shown in FIG. 6, the stop means 150, 151 may be two threaded screws. The base 110 may further comprise a holder 152 for the stop means 150, 151. The holder 152 may comprise a holder base 153 which is dimensioned such that it extends upwards from the upper side 112 of the base. The holder 152 may further comprise a holding section 154 which protrudes over a portion of the pivotal shaft 117. The holding section may comprise a first and a second opening 155, 156 for the first and second stop means 150, 151. The openings 155, 156 may comprise inner threads which correspond to outer threads of the stop means (150, 151). The two openings 155, 156 may preferably be located on either side of the pivotal shaft 117.

Figure 7:
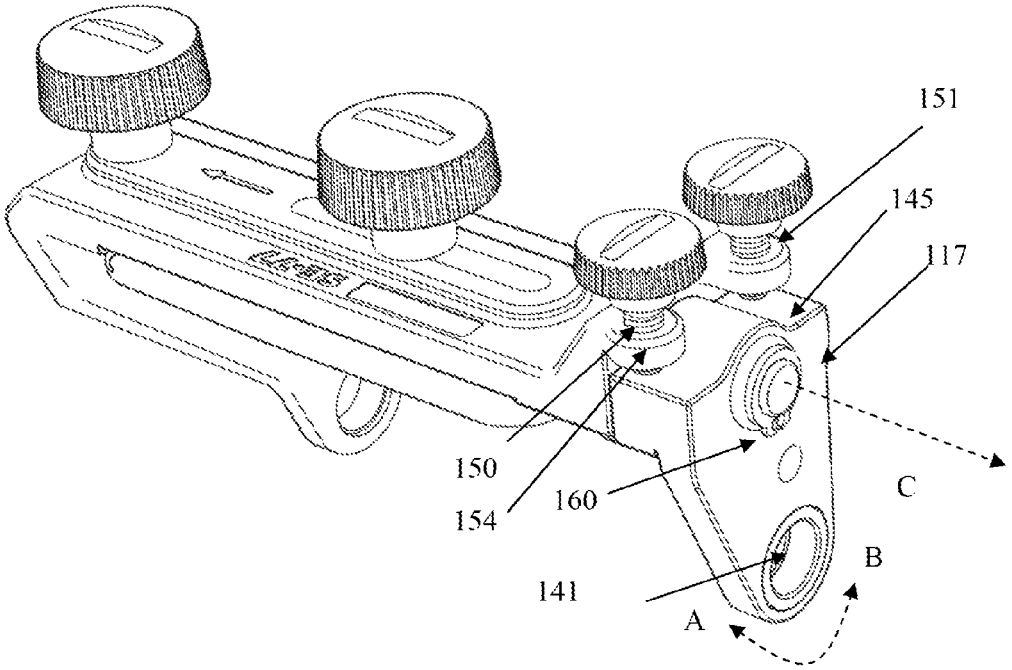
FIG. 7: A schematic drawing showing a grinding jig according to a first preferred embodiment of the present disclosure in a perspective view from above.

Reference is made to FIG. 7, which shows an embodiment of the present disclosure in which the pivotal support leg 140 is pivotally arranged on the shaft 117. The shaft may thereby, optionally, be locked with the lock ring 160. When mounted on the shaft 117, the support leg 140 may pivot or swing in directions A and B around the axis C which is parallel to longitudinal extension of the base 110 and thus parallel to the extension of the plane support surface. The holding section 154 of the holder 152 protrudes over the abutment surface 145 of the pivotal support 140 and the stop means 150, 151 are inserted into the threaded openings 155, 156 in the holding section 154.

In this position, the stop means points towards the abutment surface 145 and may independently of each other be moved towards the abutment surface 145 of the pivotal support leg or away there from. By advancing the stop means towards the abutment surface 145, the pivotal movement of the pivotal support leg is limited. By moving the stop means away from the abutment surface 145, the pivotal movement of the pivotal support leg is increased.

In the described embodiment, the stop means 150, 151 are screws. Advancement of the stop means 150, 151 towards the abutment surface 145 may thereby be achieved by turning stop means 150, 151 in clockwise direction. The stop means may be retracted from the abutment surface by turning the stop means 150, 151 in counter clockwise direction.

By moving both stop means 150, 151 into abutment with the abutment surface 145 it is possible to lock or fix the support leg 140 in a selected angular position in relation to the base 110. The angular position of the support leg 140 may be adjusted by moving one of the stop means 150, 151 away from the abutment surface and advancing the other stop means 150, 151, which is in abutment with abutment surface, towards the abutment surface. This will force the pivotal support leg to pivot in direction of the retracted stop means. The described procedure allows for easy adjustment of the inventive grinding jig so that the face of a straight edge tool may be placed into parallel alignment with the grinding surface of a grindstone.

The stop means 150, 151 may also be advanced, or retracted to a position in which there is gap, or a play, between the stop means 150, 151 and the abutment surface 145 of the pivotal support leg 140. This setting allows the support leg 140 to pivot back and forth between the two stop means 150, 151 during grinding. This is advantageously when the inventive grinding jig is used for grinding tools with cambered edges. The maximal pivotal movement of the pivotal support leg is set in dependency of the degree of camber of the tool's edge.

It should be appreciated that the maximum pivotal movement of the pivotal support leg 140 in either direction A and B may be determined by the height of the holder base 153. This is so because the protruding holding section 154 eventually may block the support leg 140. However, it is feasible for the skilled person to design the holder base such that sufficient pivotal movement of the pivotal support leg is allowed for the grinding operation in question.

Although a particular embodiment has been disclosed in detail this has been done for purpose of illustration only, and is not intended to be limiting. In particular it is contemplated that various substitutions, alterations and modifications may be made within the scope of the appended claims. For example, it is possible to realize the stop means in the form of pins, instead of screws. In that case the inner surface of the receiving openings may be smooth. Alternatively, the surface of the receiving openings may be course to increase the friction to the stop means. Instead of pivotally attaching the pivotal support leg to a fix shaft in the base it is possible to provide a fix shaft in the support leg and a corresponding receiving opening in the base. The grinding jig according to the present disclosure also provides additional advantages. For example, it enables grinding of tools with non-parallel sides, such as conical plane tools, or of tools which have been slightly deformed during use. It may also be used to compensate in a situation in which an operator exerts an uneven grinding pressure, i.e. bear down heavily on one side of the grinding jig.

Moreover, although specific terms may be employed herein, they are used in a generic and descriptive sense only and not for purposes of limitation. Furthermore, as used herein, the terms "comprise/comprises" or "include/includes" do not exclude the presence of other elements. Finally, reference signs in the claims are provided merely as a clarifying example and should not be construed as limiting the scope of the claims in any way.

The invention claimed is:

1. A grinding jig for holding an edged tool in a grinding machine, said grinding jig comprising:

a base having a plane support surface for supporting a section of the face of an edged tool;

a clamping means, arranged to clamp a section of the face of an edged tool against the flat support surface; and a first and a second support leg extending from opposite ends of the base, each support leg comprising an opening adapted to slidably and rotationally receiving a support bar of a grinding machine, wherein one support leg is pivotally attached to the base around an axis parallel with an extension of the plane support surface and in that the grinding jig comprises a first adjustable stop means for adjustably limiting the pivotal movement of the support leg in a first direction and a second adjustable stop means for adjustably limiting the pivotal movement of the support leg in a second direction.

2. The grinding jig according to claim 1, wherein the first and the second adjustable stops means are adjustable such that the pivotal support leg may pivot between the first and the second adjustable stop means.

3. The grinding jig according to claim 1, wherein the first and the second adjustable stop means are adjustable such that the pivotal support leg may be fixed in a predetermined angular position between the first and the second adjustable stop means.

4. The grinding jig according to claim 1, wherein the pivotal support leg is pivotally attached to a shaft extending from one of the opposing ends of the base.

5. The grinding jig according to claim 4, wherein an upper portion of the pivotal support leg comprises an opening for receiving the shaft and a lower portion of the pivotal support leg comprises the opening for receiving the support bar, whereby the opening for receiving the shaft and the opening for receiving the support bar are positioned in line in the centre of the pivotal support leg.

6. The grinding jig according to claim 1, wherein the pivotal support leg comprises an abutment surface, whereby the adjustable stop means are arranged to engage the abutment surface.

7. The grinding jig according to claim 6, wherein the abutment surface extends on opposite sides of the shaft.

8. The grinding jig according to claim 6, wherein the base comprises a holding section for holding the adjustable stop means, wherein the holding section protrudes over the abutment surface of the pivotal support leg.

9. The grinding jig according to claim 8, wherein the holding section comprises a first and a second opening for receiving the first and the second adjustable stop means, wherein the first and the second openings and the first and the second adjustable stop means comprises mating inner and outer threads such that the adjustable stop means may be advanced towards the abutment surface or retracted there from by screwing of the adjustable stop means.

10. A grinding machine comprising a grindstone, a motor for rotating the grindstone and a support bar for supporting a grinding jig, wherein the grinding machine comprises a grinding jig according to claim 1.

* * * * *